United States Patent [19]

Okumoto et al.

[11] Patent Number: 4,867,734

[45] Date of Patent: Sep. 19, 1989

[54] APPARATUS FOR MANUFACTURING DUAL FILTER PLUGS FOR CIGARETTES AND METHOD OF MANUFACTURING THE SAME

[75] Inventors: Yutaka Okumoto; Toyomi Arakawa, both of Tokyo; Mamoru Katoh, Hashimoto, all of Japan

[73] Assignee: Japan Tobacco Inc., Tokyo, Japan

[21] Appl. No.: 271,425

[22] Filed: Nov. 15, 1988

[30] Foreign Application Priority Data

Nov. 19, 1987 [JP] Japan ..... 62-290704

[51] Int. Cl.[4] ..... A24C 5/52

[52] U.S. Cl. ..... 493/48; 131/94

[58] Field of Search ..... 493/47, 48, 45, 39; 131/94

[56] References Cited

U.S. PATENT DOCUMENTS

| | | | |
|---|---|---|---|
| 2,898,998 | 11/1959 | Schur . | |
| 3,039,367 | 6/1962 | Stelzer | 493/47 |
| 3,245,414 | 2/1966 | Rudszinat | 131/94 |
| 3,306,306 | 7/1967 | Rudszinat | 131/94 |
| 3,308,832 | 3/1967 | Stelzer et al. . | |
| 3,368,460 | 2/1968 | Schubert | 493/45 |
| 3,487,754 | 2/1970 | Flasdieck et al. | 493/47 |
| 4,321,050 | 9/1982 | Oesterling | 493/45 |

FOREIGN PATENT DOCUMENTS 4323985 2/1971 Japan .

*Primary Examiner*—Frederick R. Schmidt
*Assistant Examiner*—Jack W. Lavinder
*Attorney, Agent, or Firm*—Nixon & Vanderhye

[57] ABSTRACT

An apparatus for manufacturing cigarette dual filter plugs according to this invention comprises a first grooved convey drum for receiving a filter rod of a first type from a first hopper and conveying the filter rod, a cutting wheel for cutting the filter rod into halves during conveyence thereof by the first convey drum, and a separation guide for separating the cut rod halves so as to leave a predetermined space therebetween. The apparatus also includes a second grooved convey drum for receiving the rod halves from the first convey drum and a filter rod of a second type from a second hopper between two rod halves, and a plurality or cutting wheels are arranged near the second convey drum to cut the two rod halves and the filter rod of the second type into equal numbers of chips, to form two groups of filter chips of the first type and one group of filter chips of the second type. The filter chips of the respective groups are then transferred from the second convey drum to a staggering drum, the filter chips of each group being staggered in the convey direction.

5 Claims, 8 Drawing Sheets

APPARATUS FOR MANUFACTURING DUAL FILTER PLUGS FOR CIGARETTES AND METHOD OF MANUFACTURING THE SAME

BACKGROUND OF THE INVENTION

1. Field of the Invention

The present invention relates to an apparatus for manufacturing dual filter plugs for cigarettes and, more particularly, to an apparatus suitable for manufacturing and feeding dual filter plugs to a production machine for filter cigarettes and a method of manufacturing and feeding the dual filter plugs.

2. Description of the Related Art

One-half of a filter plug or a filter tip is attached to one end of cigarette. The filter tip not only prevents shredded tobacco in the cigarette from entering into a mouth of a smoker during smoking, but also improves enjoyment of smoking.

A filter tip is generally, a plain filter tip. This plain filter tip is made of acetate fibers. A typical apparatus for manufacturing filter plugs will be described briefly below. The apparatus comprises drums of different types, each drum having grooves for continuously feeding one elongated plain filter rod, means for cutting the plain filter rod into filter plugs having a length twice that of the filter tip required for each cigarette, and means for aligning the filter plugs along the convey direction. The filter plugs are supplied from the filter manufacturing apparatus to a so-called wrapping machine. The wrapping machine will be described briefly below. Each filter plug is located between two adjacent series-aligned cigarettes. Chip paper is wound around these cigarettes and the filter plug to obtain two cigarettes with a double-length filter tip. The double-length filter tip is cut at the central position. Therefore, two cigarettes each with a plain filter tip are obtained.

A dual filter tip is also known as a cigarette filter in addition to the plain filter described above. A dual filter plug having a length twice that of the dual filter tip is obtained by combining a plain filter element consisting of only acetate fibers and a charcoal filter element obtained by mixing active carbon or the like in the plain filter element. For supplying the dual filter plugs from the filter manufacturing apparatus to the wrapping machine, if dual filter rods, each of which is made of the plain filter elements and the charcoal filter elements alternately arranged and connected to each other, are prepared in place of the plain filter rods, the filter manufacturing apparatus can be used without modifications.

A dual filter manufacturing apparatus disclosed in U.S. Pat. No. 4,321,050 comprises two feed units each having the same construction as that of the above filter manufacturing apparatus, and a coupling unit. In this known dual filter manufacturing apparatus, individual plain filter plugs are formed from a plain filter rod by one feed unit, and charcoal filter plugs are formed from a charcoal filter rod by the other feed unit. The resultant plain and charcoal filter plugs are received by the coupling unit. In the coupling unit, each charcoal filter plug is divided into two tips, and half-length charcoal filter tips are linearly aligned with a plain filter plug at both ends thereof, thereby obtaining double-length dual filter plugs.

As described above, when dual filter rods are prepared and dual filter plugs are to be manufactured by one filter manufacturing apparatus, an another apparatus for manufacturing dual filter rods is required in addition to the above filter manufacturing apparatus. Further, the another apparatus for manufacturing the dual filter rods needs a first filter paper to be wound around the plain filter elements and charcoal filter elements for obtaining the dual filter rod. For this reason, in the wrapping machine, when a tip paper or a second filter paper is wound around the double-length filter plug and two cigarettes to couple them, first filter paper and second filter paper overlap on the surface of the filler element. Therefore, the number of members for manufacturing dual filter cigarettes is increased to result in high manufacturing cost.

The filter manufacturing apparatus in the above U.S. patent is free from the above drawback. However, since two feed units are used, the number of grooved drums as constituting components of the respective feed units is greatly increased in the filter manufacturing apparatus as a whole. Therefore, the filter manufacturing apparatus becomes bulky and its mechanism is inevitably complicated.

SUMMARY OF THE INVENTION

The present invention has been made in consideration of the above situation, and has as its object to provide an apparatus for manufacturing dual filter plugs and a method of manufacturing the same wherein the number of grooved drums can be small, and the construction of the apparatus can be simplified and made compact.

The apparatus for manufacturing dual filter plugs comprises first and second hopper means for storing filter rods of first and second types, respectively, and first to fourth convey drums sequentially arranged below the first and second hopper means, comprising grooved drums, and constituting convey paths for the filter rods of the first and second types. The filter rods of the first type are supplied from the first hopper means to the first convey drum one by one. The filter rod of the first type is conveyed and supplied to the second convey drum upon rotation of the first convey drum. The filter rod of the first type is cut into halves by separating means to obtain two rod halves of the first type. These rod halves of the first type are spaced apart from each other by a predetermined distance along their axial direction.

The filter rod of the second type is supplied from the second hopper means to the second convey drum. The second filter rod is located between the rod halves of the first type on the second convey drum. During conveyance of the two rod halves of the first type and the filter rod of the second type, the two rod halves of the first type and the filter rod of the second type are cut into equal numbers of pieces by cutting means upon rotation of the second convey drum. Therefore, two groups of filter chips and one group of filter chips of the second type are prepared.

A staggering drum serving as a convey drum is arranged midway along the convey path, i.e., between the second and fourth convey drums. The staggering drum sequentially receives filter chips of each group from the second convey drum, so that the filter chips are sequentially staggered in the convey direction upon rotation of the staggering drum and are supplied to the fourth convey drum.

The fourth convey drum sequentially receives two filter chips of the first type and one filter chip of the second type and conveys these filter chips upon its rotation. One filter chip of the first type, the filter chip of the second type, and the other filter chip of the first type are coaxially aligned on the fourth convey drum thereby obtaining a dual filter plug.

According to the method of the present invention, the filter rods of the first and second types are supplied to one convey path comprising the grooved drums described above. During the conveyance of the filter rods of the first and second types, the same operation as the above-mentioned apparatus can be performed.

According to the apparatus for manufacturing a dual filter and a method of manufacturing the same, two types of filter rods can be handled on one convey path constituted by the grooved drums. Even if an additional apparatus is not combined with the apparatus of the present invention, dual filter plugs can be manufactured. In addition, the number of grooved drums required in the apparatus of the present invention can be reduced as compared with that in the conventional apparatus. As a result, the apparatus of the present invention has a simple structure and can be made compact.

DETAILED DESCRIPTION OF THE PREFERRED EMBODIMENTS

An embodiment of the present invention will be described in detail with reference to the accompanying drawings.

Figure 1:
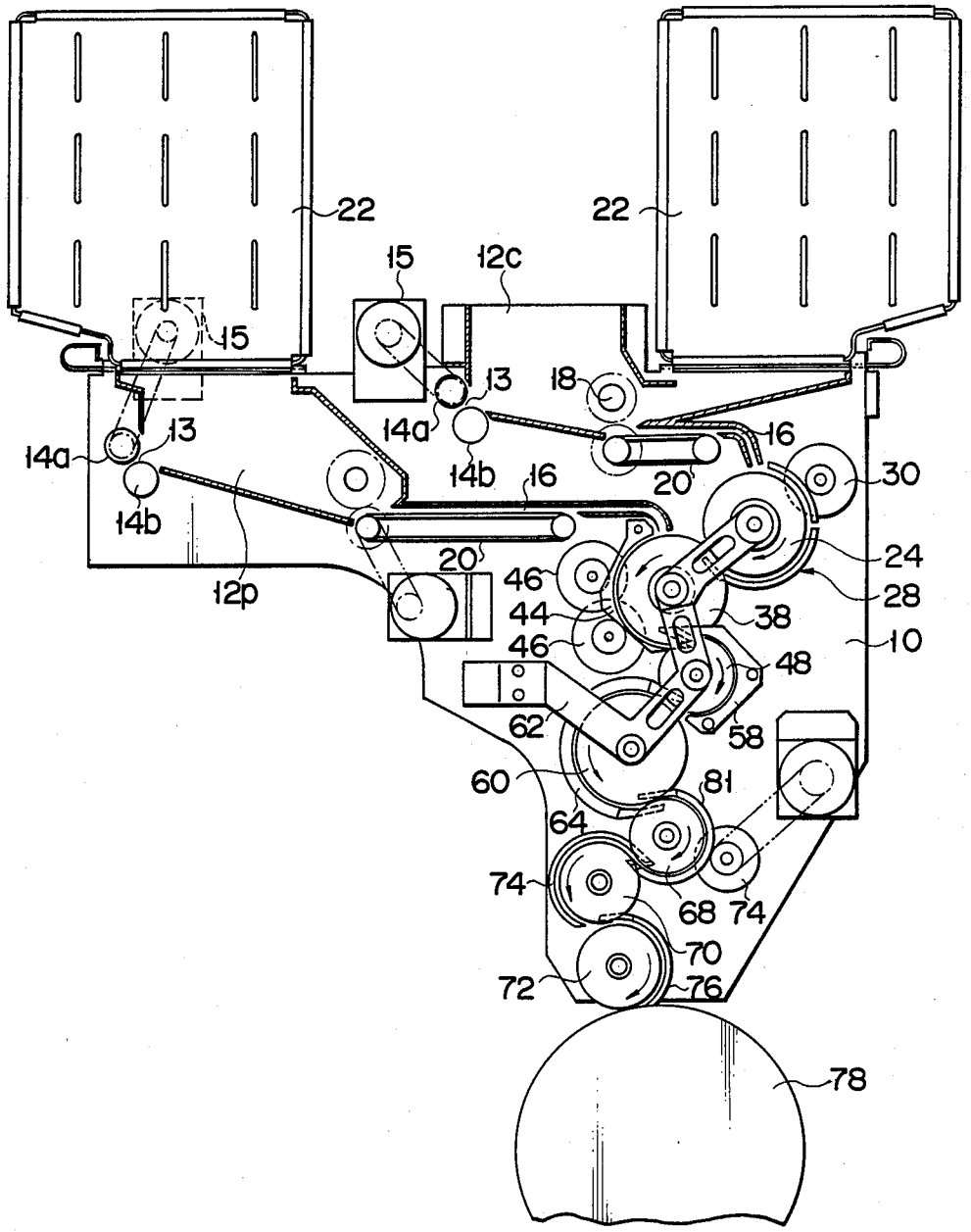
FIG. 1 is a schematic view showing an overall construction of an apparatus.

FIG. 1 shows an overall construction of a dual filter manufacturing apparatus. This apparatus comprises base plate 10 extending in the vertical direction. First hopper 12*c* is disposed in an upper portion of base plate 10.

A large number of filter rods Fc of a first type, each having a predetermined length (although not shown in FIG. 1), are stored in first hopper 12*c*. In this embodiment, filter rods Fc are charcoal filter rods obtained by adding active carbon particles in acetate fibers.

A pair of feed rollers 14*a* and 14*b*, parts of outer surfaces of which are exposed in first hopper 12*c*, are disposed in the lower portion of first hopper 12*c* so as to be rotatable in opposite directions. Upon rotation of rollers 14*a* and 14*b*, each filter rod Fc in first hopper 12*c* is pushed out toward feed-out passage 16 extending from first hopper 12*c*. Feeding of filter rods Fc to first hopper 12*c* will be briefly described. Filter rods Fc are fed with air flow from a direction perpendicular to the plane of the drawing to reception passage 13 defined between feed rollers 14*a* and 14*b*. Filter rod Fc in reception passage 13 is supplied to first hopper 12*c* upon rotation of feed rollers 14*a* and 14*b*. Reference numeral 15 denotes a motor for rotating feed rollers 14*a* and 14*b*.

Roller 18 is rotatably disposed near the inlet of feed-out passage 16 in first hopper 12*c*. This roller 18 is rotated counterclockwise in FIG. 1, so that filter rods Fc in first hopper 12*c* are smoothly guided from the inlet of feed-out passage 16 therein one by one. As is apparent from FIG. 1, part of feed-out passage 16 is constituted by belt conveyor 20. Upon driving of belt conveyor 20, filter rod Fc in feed-out passage 16 is guided to an outlet of feed-out passage 16 and is delivered through the outlet. Auxiliary trays 22 for storing filter rods Fc are arranged near first hopper 12*c* as needed.

Second hopper 12*p* is arranged to the left of first hopper 12*c* in the upper portion of base plate 10. A large number of filter rods Fp of a second type different from filter rods Fc of the first type, each having a predetermined length, are stored in second hopper 12*p*. Second hopper 12*p* has a similar structure as that of first hopper 12*c*. Members of second hopper 12*p*, which have the same functions as those of first hopper 12*c*, are denoted by the same reference numerals, and a detailed description thereof will be omitted.

First convey drum 24 is disposed immediately below the outlet of feed-out passage 16 in first hopper 12*c*. First convey drum 24 is rotatably supported by base plate 10 and is rotated clockwise in FIG. 1 at a predetermined circumferential speed.

Figure 2:
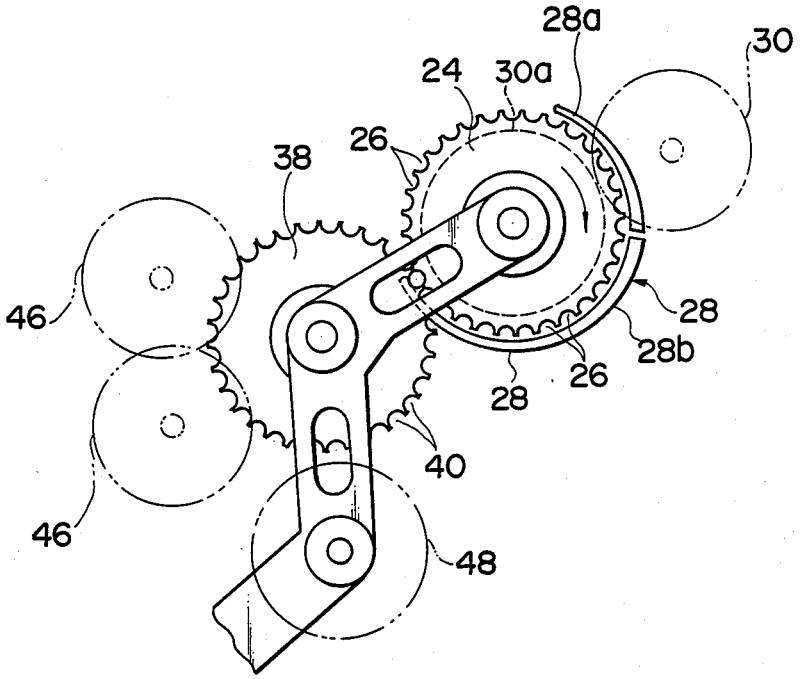
FIG. 2 is an enlarged side view of first and second convey drums.

As illustrated as an enlarged view of FIG. 2, first convey drum 24 comprises a grooved drum having a large number of first convey grooves 26 on its circumferential surface. Each first convey groove 26 has a semicircular cross section which allows reception of filter rod Fc of the first type therein. First grooves 26 are equidistantly spaced apart in the circumferential direction of first convey drum 24, and axes of grooves 26 are parallel to the axis of first convey drum 24.

Filter rods Fc of the first type fed out from first hopper 12*c* are supplied to first convey grooves 26 of first convey drum 24 one by one and are conveyed upon rotation of first convey drum 24.

First convey guide 28 having an arcuated shape is disposed to cover substantially the right half of the circumferential surface of first convey drum 24 so as to guide conveyance of filter rods Fc upon rotation of first convey drum 24. During conveyance of filter rod Fc, first convey guide 28 prevents filter rods Fc from being removed from first convey grooves 26 of first convey drum 24.

Figure 3:
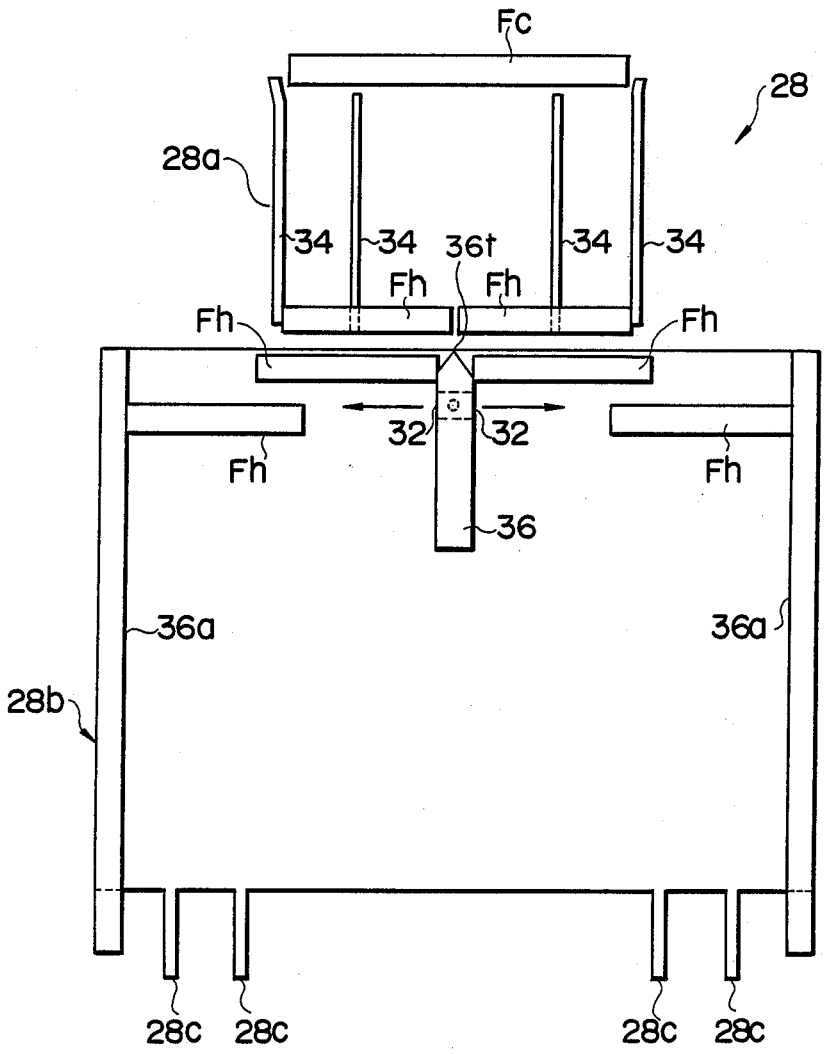
FIG. 3 is a developed view showing the inner surface of a first convey path.

First convey guide 28 includes first and second portions 28*a* and 28*b* sequentially positioned from the outlet side of feed-out passage 16. First cutting wheel 30 constituting a first cutting mechanism is rotatably arranged at first portion 28*a*. A peripheral edge of first cutting wheel 30 extends through first portion 28*a* and inserted in an annular groove 30*a* formed in the center of the circumferential surface of first convey drum 24. The circular blade of first cutting wheel 30 is deeper than each first convey groove 26. As is apparent from FIG. 3 showing the developed view from the inner surface side, first portion 28*a* comprises, e.g., four arcuated guide plates 34. These guide plates 34 are spaced apart from each other by predetermined intervals along the axial direction of first convey drum 24. The pair of outermost guide plates 34 guide both ends of filter rod Fc. The circular blade of first cutting wheel 30 is passed between remaining guide plate 34 and is inserted in the groove 30*a* of first convey drum 24.

When filter rod Fc passes through first cutting wheel 30 during conveyance upon rotation of first convey drum 24, filter rod Fc is cut into halves, thereby obtaining two rod halves Fh of the first type, as shown in FIG. 3. In the subsequent operations, therefore, filter rod Fc of the first type is conveyed as two rod halves Fh of the first type by first convey drum 24.

A part of second portion 28*b* of first convey guide 28 has a larger width than that of first portion 28*a*. Separation guide 36 constituting a separating mechanism is mounted on the center of the inner surface of second portion 28*b* near first portion 28*a*, as shown in FIG. 3. Separation guide 36 has an arcuated shape along the inner surface of second portion 28*b*. An upstream end of separation guide 36 along the convey direction is tapered toward first portion 28*a*. When two rod halves Fh thus obtained reach second portion 28*b*, they are separated in the axial direction by tip 36*t* of separation guide 36 in their first convey groove 26. Blowing holes 32 for compressed air are formed in both side faces of separation guide 36 and are connected to a compression source (not shown). When rod halves Fh of separated by tip 36*t* of separation guide 36 are conveyed to the position of blowing holes 32, rod halves Fh are moved in the axial direction by compressed air from blowing holes 32 within corresponding first convey groove 26. Rod halves Fh abut against guide plates 36*a* disposed at both sides of second portion 28*b*. As a result, a space having a predetermined distance, i.e., a space which allows reception of filter rod Fp of the second type, can be defined between rod halves Fh of the first type.

Second convey drum 38 is arranged below first convey drum 24 at a position slightly to the left of first convey drum 24 so as to be in rolling contact with first convey drum 24. Second convey drum 38 is rotatably supported by base plate 10 in the same manner as in first convey drum 24. However, second convey drum 38 is rotated in a direction opposite to that of first convey drum 24.

Second convey grooves 40 spaced apart from each other at predetermined intervals in the circumferential direction are formed on the circumferential surface of second convey drum 38 (FIG. 2). The axes of second convey grooves 40 are parallel to the axis of second convey drum 38. The cross-sectional shape of each second convey groove 40 is the same as that of first convey groove 26.

Second convey drum 38 is rotated such that each second convey groove 40 mates with the corresponding one of first convey grooves 26 of first convey drum 24. In other words, when first and second convey grooves 26 and 40 are formed at the same intervals, first and second convey drums 24 and 38 are rotated at an equal circumferential speed.

Figure 4:
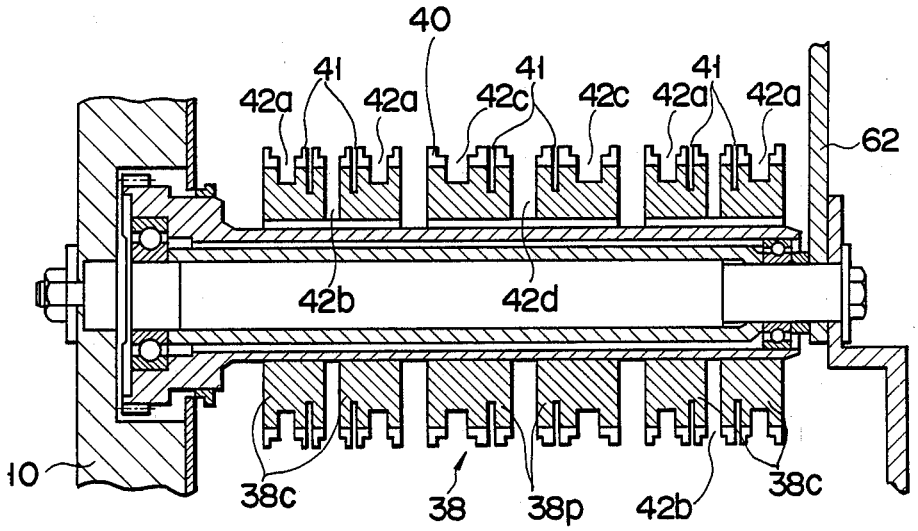
FIG. 4 is a longitudinal sectional view of the second convey drum.

When first and second convey drums 24 and 38 are rotated in opposite directions as described above, two rod halves Fh in a given one of first convey grooves 26 of first convey drum 24 are transferred to the corresponding one of second convey groove 40 of second convey drum 38 when the corresponding first and second convey grooves are matched with each other. Two rod halves Fh are then conveyed upon rotation of second convey drum 38. In order to assure transfer of rod halves Fh between first and second convey drums 24 and 38, four fork fingers 28*c* extend from the lower end of first convey guide 28, i.e., from the lower end of second portion 28*b*, as shown in FIG. 3. These fork fingers 28*c* are inserted in a plurality of annular grooves 42*a* (FIG. 4) formed on the circumferential surface of second convey drum 38. The longitudinal section of second convey drum 38 is illustrated in FIG. 4. As is apparent from FIG. 4, second convey drum 38 comprise six disks. The pair of leftmost disks 38*c* and the pair of rightmost disks 38*c* are used to convey rod halves Fh. Therefore, annular grooves 42*a* described above are respectively formed in disks 38*c*.

Figure 10:
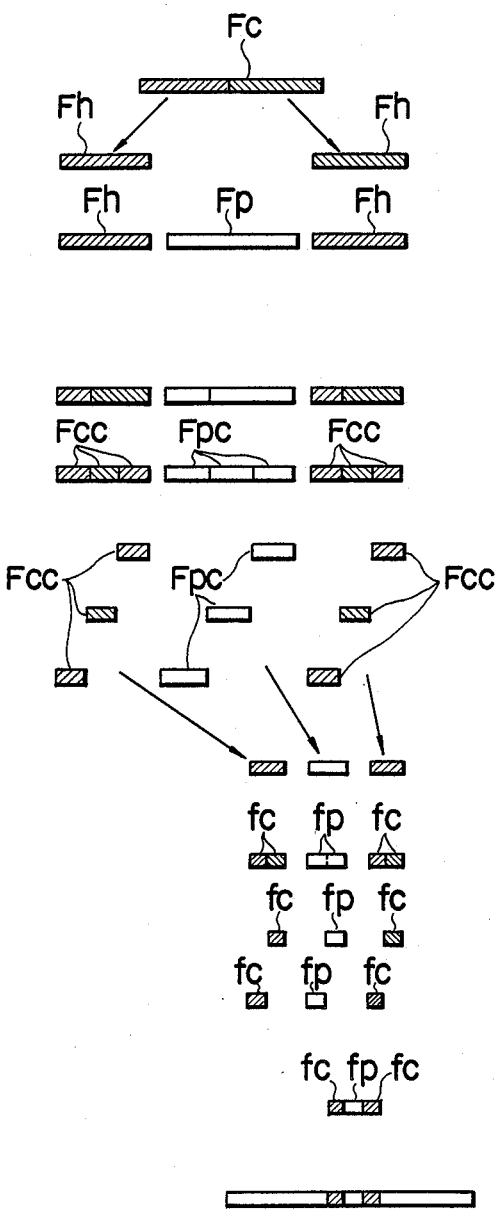
FIG. 10 is a view showing operational procedures of filter rods of first and second types.

As is apparent from FIG. 1, feed-out passage 16 of second hopper 12*p* extends near second convey drum 38, and the outlet of second hopper 128 is located immediately above the circumferential surface of second convey drum 38. That is, filter rods Fp of the second type in second hopper 12*p* are fed to second convey grooves 40 of second convey drum 38 one by one. Filter rod Fp fed to second convey groove 40 is located between two rod halves Fh of the first type which have already been fed from first convey drum 24. That is, filter rod Fp is received by two central disks 38*p* of all the disks of second convey drum 38. Therefore, as shown in FIG. 10, two rod halves Fh of the first type and filter rod Fp of the second type, both of which are supplied to second convey groove 40 of second convey drum 38, are conveyed upon rotation of second convey drum 38.

Second convey guide 44 is disposed to extend from the outlet of feed-out passage 16 of second hopper 12*p* along substantially the left half of the circumferential surface of second convey drum 38, as shown in FIG. 1. Second convey guide 44 has basically the same functions as those of first convey guide 28.

A plurality of second cutting wheels 46 constituting a second cutting mechanism are arranged outside second convey drum 38. In this embodiment, two second cutting wheels 46 are provided for each of two rod halves Fh, and two second cutting wheels 46 are also provided for filter rod Fp. Therefore, a total of six second cutting wheels 46 are used in this embodiment.

Four second cutting wheels 46 used for two rod halves Fh are used to cut each rod half Fh into three pieces. As a result, each rod half Fh of the first type constitutes filter chip group Fcg of the first type consisting of three filter chips Fcc of the first type. Two second cutting wheels 46 for one filter rod Fp of the second type are used to cut each filter rod Fp into three pieces. Each filter rod Fp of the second type constitutes filter chip group Fpg of the second type consisting of three filter chips Fpc of the second type.

The circular blade of each second cutting wheel 46 extends through second convey guide 44 and is inserted in annular groove 41 (FIG. 4) formed on the circumferential surface of second convey drum 38. Regarding layout of these second cutting wheels 46, each pair of wheels are arranged in the circumferential direction of second convey drum 38, i.e., in the upstream and downstream sides along the convey direction. Second cutting wheels 46 cut the filter rod halves Fh and the filter rod Fp into chips to constitute two filter chip groups Fcg of the first type and filter chip group Fpg of the second type, as indicated by the operational procedures in FIG. 10.

Staggering drum 48 is disposed in rolling contact with second convey drum 38 therebelow. Staggering drum 48 is also rotatably supported by base plate 10. The rotational direction of staggering drum 48 is opposite to that of second convey drum 38.

Figure 5:
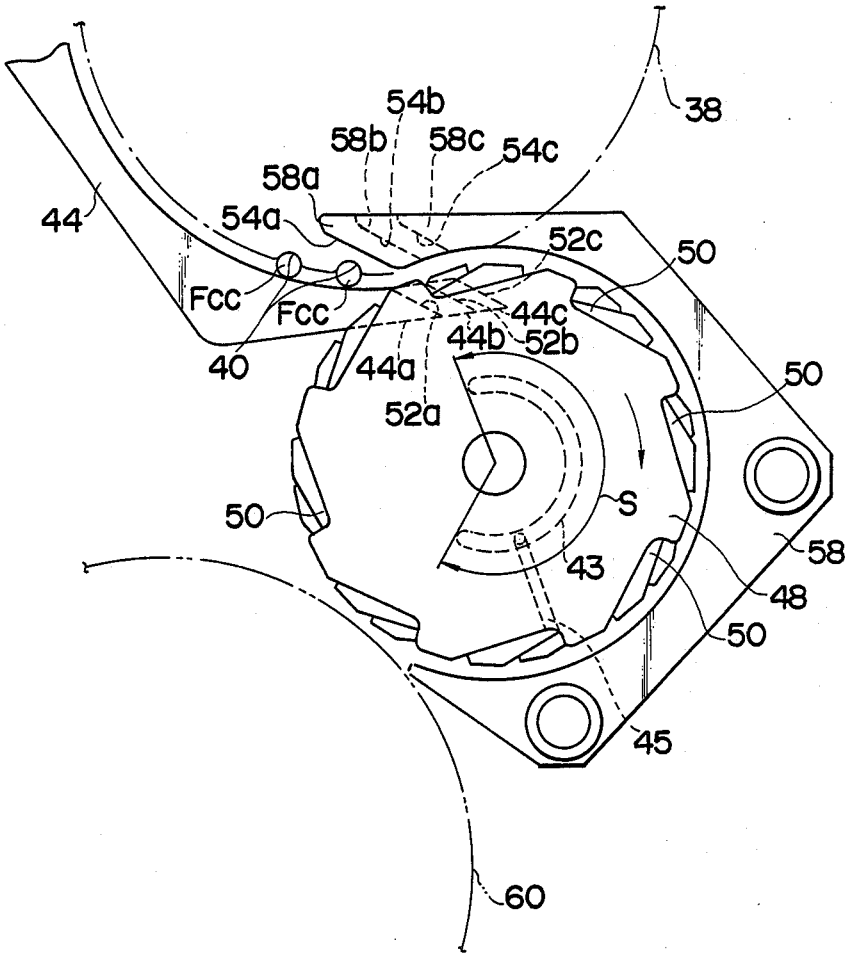
FIG. 5 is an enlarged side view of a staggering drum.

As best illustrated in FIG. 5, staggering drum 48 comprises a grooved drum. However, the groove shape of staggering drum 48 is greatly different from those of first and second convey drums 24 and 38. That is, a plurality of receiving regions separated and arranged in the axial direction are formed on the periphery of staggering drum 48. These receiving regions are defined in correspondence with filter chips Fcc and Fpc of the respective filter chip groups. Therefore, staggering drum 48 has a total of nine receiving regions.

Each receiving region of staggered drum 48 has a plurality of staggering groove formed to be parallel to the axis of rotation of staggering drum 48, as shown in FIG. 5. Front walls of staggering grooves 50 are inclined to increase opening widths of staggering grooves 50 when viewed in the rotational direction of staggering drum 48.

Rotational phases of staggering grooves 50 of three receiving regions, which are arranged side by side and corresponding to the respective filter chip groups, are different from each other. For the sake of simplicity, the three receiving regions corresponding to filter chip group Fcg of the first type will be described. As is apparent from FIG. 5, the rotational phases of staggering grooves 50 of the respective receiving regions are different from each other within the range of one pitch between adjacent staggering grooves 50. The circumferential pitches of staggering grooves 50 of the receiving region are the same as those of second convey grooves 40 of second convey drum 38.

As indicated by a broken line in FIG. 5, the lower end of second convey guide 44 has a fork-like shape and is inserted into a plurality of annular grooves formed on the circumferential surface of staggering drum 48. More specifically, the annular groove (although not shown) in formed in the center of each receiving region of staggering drum 48. Thus, the number of these annular groves is nine, and the number of fork fingers at the lower end of second convey guide 44 is also nine.

Figure 6:
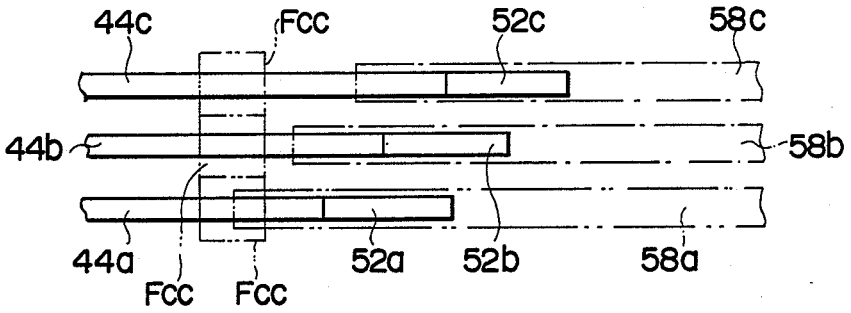
FIG. 6 is a view showing a relationship between a fork portion of a second convey guide and a fork portion of a staggering convey guide.

FIG. 6 shows three fork fingers 44*a*, 44*b*, and 44*c* of second convey guide 44, which are used to handle one filter chip groove Fcg of the first type. The lengths of fork fingers 44*a*, 44*b*, and 44*c* when viewed in the circumferential direction of second convey drum 38 are different from each other. More specifically, as is apparent from FIG. 6, fork finger 44*a* is the shortest, fork finger 44*b* is longer than fork finger 44*a*, and fork finger 44*c* is the longest. Distal end portions of fork fingers 44*a*, 44*b*, and 44*c* have inclined surfaces 52*a*, 52*b*, and 52*c*, respectively, which are parallel to each other and inclined downward toward the inside of staggering drum 48.

Staggering convey guide 58 is disposed along substantially the right half circumferential surface of staggering drum 48. The upper end portion of staggering convey guide 58 also has a fork portion in the same manner as in the lower end portion of second convey guide 44. Fork fingers of this staggering convey drum 58 are respectively inserted in annular grooves formed on the circumferential surface of second convey drum 38. In this case, these annular grooves include annular grooves 42*b* between adjacent drum disks 38*c* of second convey drum 38, annular grooves 42*c* formed in disks 38*p*, and annular grooves 42*d* formed between disks 38*p* in addition to annular grooves 42*a* formed in second convey drum 38.

The fork fingers of staggering convey guide 58 cooperate with the fork fingers of second convey guide 44. FIGS. 5 and 6 show only fork fingers 58*a*, 58*b*, and 58*c* of staggering convey guide 58 which respectively cooperate with fork fingers 44*a*, 44*b*, and 44*c* of second convey guide 44. In this case, fork fingers 58*a*, 58*b*, and 58*c* are located immediately above cooperating fork fingers 44*a*, 44*b*, and 44*c*. The lengths of fork fingers 58*a*, 58*b*, and 58*c* when viewed in the circumferential direction of staggering drum 48 become gradually shorter. Inclined surfaces 54*a*, 54*b*, and 54*c* parallel to inclined surfaces 52*a*, 52*b*, and 52*c* of cooperating fork fingers 44*a*, 44*b*, and 44*c* are formed at the distal end portions of fork fingers 58*a*, 58*b*, and 58*c*. The pairs of inclined surfaces 52*a* and 54*a*, 52*b* and 54*b*, and 52*c* and 54*c* cooperate with each other to serve as guides for guiding filter chips Fcc of filter chip group Fcg of the first type from second convey drum 38 to staggering drum 48.

Staggering drum 48 is rotated in a direction opposite to that of second convey drum 38, as previously described. However, the circumferential speed of staggering drum 48 is three times that of second convey drum 38. In other words, staggering drum 48 is rotated by an angle corresponding to three staggering grooves 50 while second convey drum 38 is rotated by an angle corresponding to one second convey groove 40.

Staggering drum 48 has three rows of receiving regions having staggering grooves 50 described above. When filter chip group Fcg reaches a contact position between second convey drum 38 and staggering drum 48 upon rotation of second convey drum 38 and staggering drum 48, one (filter chip Fcc located at this side in FIG. 5) of three filter chips Fcc of filter chip group Fcg is guided by inclined surface 54*a* of fork finger 58*a* and inclined surface 52*a* of fork finger 44*a* from second convey drum 38 to staggering drum 48. This filter chip Fcc is received by staggering groove 50 of the corresponding receiving region (FIG. 5) of the three rows and is conveyed upon rotation of staggering drum 48. Thereafter, remaining two filter chips Fcc are delayed and guided to staggering drum 48 by inclined surfaces 54*b* and 54*c* of fork fingers 58*b* and 58*c* and inclined surfaces 52*b* and 52*c* of fork fingers 44*b* and 44*c*. These remaining chips Fcc are sequentially delayed and received by staggering grooves 50 of the corresponding receiving regions of staggering drum 48. As a result, regarding filter chip group Fcg of the first type received from second convey drum 38 to staggering drum 48, remaining filter chips Fcc are sequentially delayed from leading filter chip Fcc and are conveyed. In other words, three filter chips Fcc of the first type are conveyed in a staggered state in the convey direction upon rotation of staggering drum 48.

The above operations are completed before next filter group Fcg of the first type in second convey drum 38 reaches the contact position and are repeated for each filter chip Fcc of next filter chip group Fcg.

In order to assure feeding of filter chips Fcc of the first type on staggering drum 48 and transfer of each filter chip to a third convey drum (to be described later), when each staggering groove 50 is located in suction area S in FIG. 5, filter chip Fcc is held by suction air. That is, as shown in FIG. 5, a fixing disk (not shown) is arranged to be in slidable contact with staggering drum 48, and its end face at side of staggering drum 48 is provided with arcuated suction groove 43 within suction area S. Suction groove 43 is always connected to a negative pressure source (not shown). One end of suction hole 45 is open at the bottom of each staggering groove 50. The other end of suction hole 45 communicates with suction groove 43 when corresponding staggering groove 50 is located in suction area S upon rotation of staggering drum 48. Only suction hole 45 corresponding to one staggering groove 50 is illustrated in FIG. 5. With such a suction mechanism, even if the lower end of staggering convey guide 58 is not inserted in the third convey drum, each filter chip can be appropriately transferred from staggering drum 48 to the third convey drum.

In the above description, transfer of three filter chips Fcc in one filter chip group Fcg from second convey drum 38 to staggering drum 48 has been exemplified. However, three filter chips Fcc in the other filter chip group Fcg and three filter chips Fpc in filter chip group Fpg can be transferred from second convey drum 38 to staggering drum 48 by similar mechanisms in a staggered manner, as in three filter chips Fcc of one filter chip group Fcg. Therefore, filter chips Fcc of two filter chip groups Fcg of the first type and filter chips Fpc of filter chip group Fpg of the second type are conveyed and staggered on staggering drum 48 in the convey direction, as shown In FIG. 10. As is apparent from FIG. 10, the filter chips of each filter chip group staggered and conveyed on the staggering drum are synchronized with filter chips of the adjacent filter chip group. In other words, filter chip Fpc of the second type is located between two filter chips Fcc of the first type, and at the same time, three filter chips Fcc, Fpc, and Fcc are coaxially aligned and conveyed.

Third convey drum 60 is disposed below staggering drum 48 so as to be in rolling contact with staggering drum 48. Third convey drum 60 is rotatably supported by base plate 10 and is rotated in a direction opposite to staggering drum 48. Reference numeral 62 in FIG. 1 denotes a support arm for rotatably supporting ends of first to third convey drums 24, 38, and 60 and staggering drum 48 at side opposite to base plate 10.

A plurality of third convey grooves 80 (FIG. 8) are formed on the circumferential surface of third convey drum 60. Third convey grooves 80 are equidistantly spaced apart from each other in the circumferential direction and are parallel to the axis of third convey drum 60. Each third convey groove 80 has a semicircular section in the same manner as first and second convey grooves 26 and 40.

Third convey drum 60 can be rotated such that each third convey groove 80 can mate with staggering grooves 50 of staggering drum 48.

Two filter chips Fcc and filter chip Fpc located between these filter chips Fcc, all of which are conveyed upon rotation of staggering drum 48, are transferred from staggering drum 48 to one third convey groove 80 of third convey drum 60 and are conveyed upon rotation of third convey drum 60.

Third convey guide 64 is disposed along substantially the left half circumferential surface of third convey drum 60 in the same manner as in second convey drum 38. Third convey guide 64 has functions for conveying and guiding filter chips Fcc and Fpc.

Figure 7:
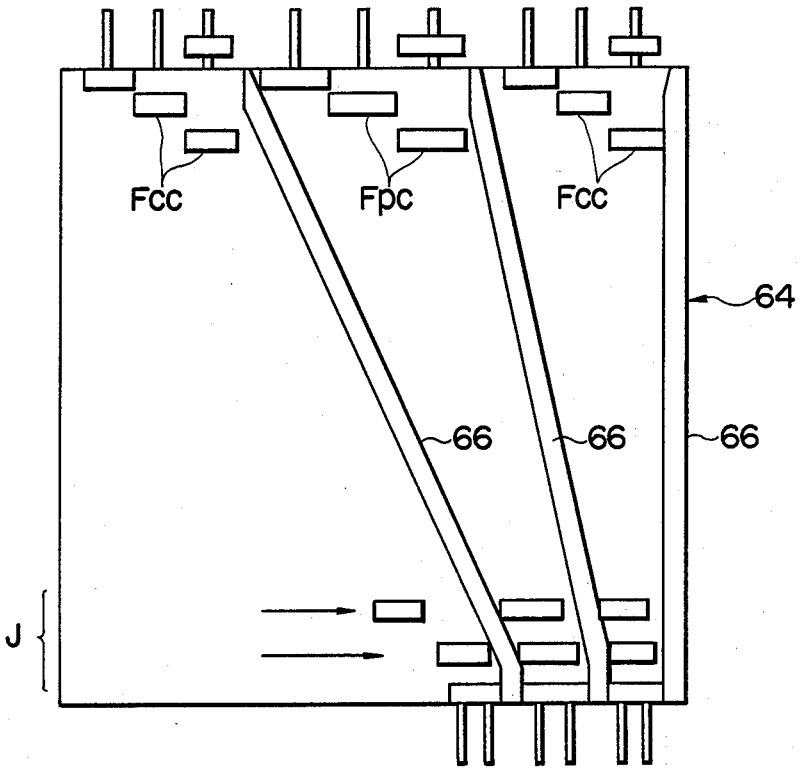
FIG. 7 is a developed view showing the inner surface of a third convey path.

The inner surface of third convey guide 64 is shown in a developed view of FIG. 7. As is apparent from FIG. 7, three guide rails 66 spaced apart from each other in the axial direction of third convey drum 60 are mounted on the inner surface of third convey guide 64 along the circumferential surface of third convey drum 60. Guide rails 66 have a function for causing filter chip Fcc of one filter chip group Fcg and filter chip Fpc supplied to given third convey groove 80 to come close to each other during conveyance thereof on third convey drum 60, as shown in FIG. 7. During conveyance on third convey drum 60, filter chip Fcc of the other filter chip group Fcg is moved within this third convey groove 80 by blowing air and abuts against and guided by corresponding guide rail 66. Therefore, the filter chip Fcc of the other filter chip group Fcg comes close to filter chips Fcc and Fpc guided by guide rails 66. Therefore, two filter chips Fcc and one filter chip Fcp which have passed through guide rails 66 are coaxially aligned and conveyed.

Figure 8:
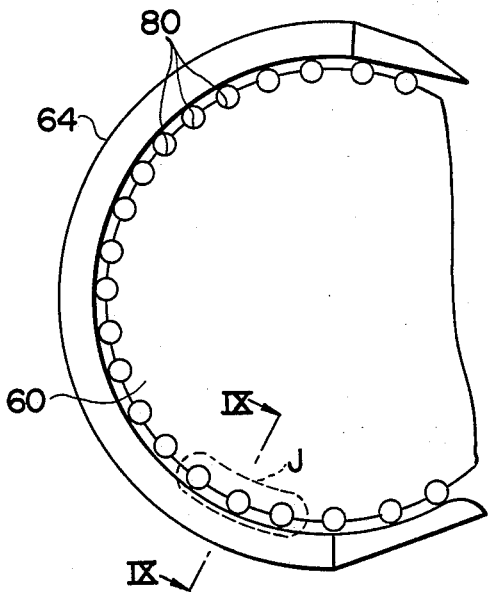
FIG. 8 is a side view of the third convey guide.
Figure 9:
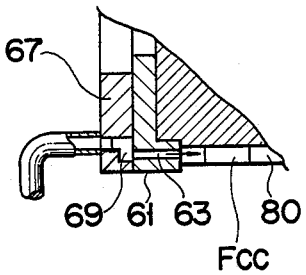
FIG. 9 is a partial sectional view of an aligning drum.

A blowing area of compressed air in FIGS. 7 and 8 is represented by reference symbol J. A blowing mechanism will be described below. As shown in FIG. 9, disk 61 is fixed on one end face of third convey drum 60. Blowing holes 63 at angular intervals equal to those of third convey grooves 80 are formed in the peripheral portion of disk 61. One end of each blowing hole 63 always communicates with corresponding third convey groove 80. In addition, control ring 67 is mounted outside disk 61. Control ring 67 is fixed regardless of rotation of third convey drum 60, i.e., disk 61. Therefore, disk 61 can be brought into slidable contact with control ring 67. Arcuated groove 69 is formed in the end face of control ring 67 at side of disk 61 in the range corresponding to blowing area J. Blowing groove 69 is connected to a compressed air source (not shown) at one end through hoses and blowing groove 69 can be connected one blowing holes 63 at the other end upon rotation of third convey drum 60.

Nine fork fingers extend from the upper end of third convey guide 64. These fork fingers are inserted into the annular grooves of staggering drum 48, respectively.

Fourth convey drum 68, second staggering drum 70, and fifth convey drum 72 are arranged below third convey drum 60 so that the adjacent drums are in rolling contact with each other.

Fourth convey drum 68 is a grooved drum corresponding to first convey drum 24. Three third cutting wheels 74 are provided to fourth convey drum 68. Third cutting wheels 74 equally cut one filter chip Fcc, filter chip Fpc, and the other filter chip Fcc which are received from third convey drum 60. Therefore, four chip halves fc of the first type and two chip halves fp of the second type are obtained.

Chip halves fc and chip halves fp are conveyed and staggered in the convey direction by second staggering drum 70, which has the same functional structure as that of staggering drum 48, and staggering convey guide 74 having the same functional structure as that of staggering guide 58, as shown in FIG. 10. These chip halves are aligned by fifth convey guide 76 having the same function as that of third convey guide 64 on fifth convey drum 72 corresponding to third convey drum 60. As a result, chip half fp of the second type is located between two chip halves fc of the first type, thereby obtaining a dual filter plug. It should be noted that second staggering drum 70 is rotated at a circumferential speed twice that of fourth convey drum 68 since two chip halves are staggered in the convey direction.

The dual filter plug thus obtained is fed from fifth convey drum 72 to grooved drum 78 on a wrapping machine side. The dual filter plug is combined with two cigarettes on grooved drum 78. The dual filter plug and two cigarettes are connected by a paper to obtain a cigarette structure with the dual filter plug for two cigarettes with dual filter tips. This structure is cut into halves to obtain two dual filter cigarettes.

Referring to FIG. 1, fourth convey guide 81 of fourth convey drum 68 corresponds to second convey guide 44. The upper end of fourth convey guide 81 has a fork-like shape, and its fork fingers are inserted into third convey drum 60. Fork fingers at the lower end of third convey guide 64 shown in FIG. 7 are inserted into fourth convey drum 68.

The present invention is not limited to the particular embodiment described above. Various changes and modifications may be made. In the above embodiment, two staggering drums are used to stagger the filter chip and the chip halves in the convey direction. However, if each rod half Fc or Fp is equally cut into four pieces, fourth convey drum 68, second staggering drum 70, fifth convey drum 72, and the like can be omitted. The number of rod halves on second convey drum 38 need not be limited to three and can be changed in accordance with the length of a filter rod supplied to the apparatus of the present invention.

What is claimed is:

1. An apparatus for manufacturing dual filter plugs applied to cigarettes, comprising:

first hopper means, for storing a large number of filter rods of a first type and feeding out said filter rods one by one;

second hopper means, for storing a large number of filter rods of a second type, different from the filter rods of the first type, and feeding out the filter rods of the second type one by one;

first conveying means, for receiving a filter rod of the first type from said first hopper means and conveying the filter rod of the first type, said first conveying means including a first convey drum rotated in one direction, and a plurality of first convey grooves formed on a circumferential surface of said first convey drum, equidistantly spaced apart from each other in a circumferential direction, and extending to be parallel to an axis of said first convey drum, said first convey grooves being capable of receiving the filter rod of the first type;

second conveying means, for receiving a filter rod of the second type from said second hopper means and conveying the filter rod of the second type, said second conveying means including a second convey drum so arranged in rolling contact with said first convey drum and rotated in a direction opposite to that of said first convey drum, and a plurality of second convey grooves formed on a circumferential surface of said second convey drum, equidistantly spaced apart from each other in the circumferential direction, and extending to be parallel to an axes of said second convey drum, one of said second convey grooves being capable of receiving the filter rod of the first type from one of said first convey grooves and the filter rod of the second type from said second hopper means;

separating means for cutting the filter rod of the first type in said first convey groove into two rod halves having the same length, during conveyance of the first filter rod of the first type from said first convey drum to said second convey drum, and separating the two rod halves by a distance such as to allow the filter rod of the second type to be positioned between the two rod halves of the first type, the filter rod of the second type being positioned between the two rod halves of the first type when the two rod halves of the first type and the filter rod of the second type are supplied to a given one of said second convey grooves;

cutting means for cutting the two rod halves of the first type and the filter rod of the second type received in said given second convey groove into chips of same numbers, thereby forming two groups of filter chips of the first type and one group of filter chips of the second type;

third conveying means, for receiving the two groups of filter chips of the first type and the one group of filter chips of the second type from said second convey groove of said second convey drum and conveying the received filter chips, said third conveying means including a third convey drum so arranged in rolling contact with said second convey drum and rotated in a direction opposite to that of said second convey drum, and a plurality of staggering grooves formed on a circumferential surface of said third convey drum in units of groups, said plurality of staggering grooves being capable of receiving the filter chips such that the filter chips of the respective groups are coaxially aligned and the filter chips of each group are staggered in a rotational direction of said third convey drum; and fourth conveying means, for receiving the filter chips of the respective groups from one of said staggering grooves of said third convey drum, said fourth conveying means including a fourth convey drum so arranged in rolling contact with said third convey drum and rotated in a direction opposite to that said third convey drum, and a plurality of aligning grooves formed on a circumferential surface of said fourth convey drum and equidistantly spaced apart from each other along the circumferential direction, said plurality of aligning grooves being capable of simultaneously receiving the coaxially aligned filter chips of the first and second types.

2. An apparatus according to claim 1, wherein said separating means comprises an annular groove having a depth greater than that of said first convey grooves and formed on said circumferential surface of said first convey drum so as to cross said first convey grooves, and one cutting wheel rotated such that a blade edge thereof is inserted in said annular groove.

3. An apparatus according to claim 2, wherein said first conveying means comprises an arcuated convey guide for the filter rod of the first type, arranged to partially surround said circumferential surface of said first convey drum, and said separating means comprises a separation guide extending on an inner surface of said first convey guide in a convey direction of the filter rod of the first type and located at a downstream side of said cutting wheel when viewed in the convey direction, said separation guide being provided with a tip at an upstream end in the convey direction, said tip being inserted between the cut rod halves of the first type to separate the two rod halves of the first type in the first convey groove, a pair of stopper guides, located at either side of said separation guide, so as to sandwich said separation guide and extend in the convey direction, for guiding conveyance of the rod halves of the first type, and blowing means for blowing air from said separation guide onto said pair of stopper guides in said first convey groove, to move the two rod halves of the first type separated by said tip of said separation guide to said corresponding stopper guides.

4. An apparatus according to claim 1, wherein said cutting means comprises a plurality of annular grooves having a depth greater than that of said second convey grooves and formed on said circumferential surface of said second convey drum so as to cross said second convey grooves, and a plurality of cutting wheels rotated such that blade edges thereof are inserted in said corresponding annular grooves.

5. An apparatus according to claim 1, wherein said fourth conveying means comprises an arcuated convey guide for the filter chips, arranged to partially surround said circumferential surface of said fourth convey drum, three guide rails, extending in the convey direction of the filter chips, for guiding both ends of the filter chips of two of the three groups and causing two coaxial filter chips of the two groups to come close to each other in said aligning groove, and blowing means for blowing air onto the filter chip of a remaining group, to move the filter chip of the remaining group toward the corresponding guide rail thereby causing three coaxial filter chips to come close to each other.

* * * * *